United States Patent [19]

Mogannam

[11] 4,043,565

[45] Aug. 23, 1977

[54] RECREATIONAL DEVICE

[76] Inventor: Paul Mogannam, 3220 Geary Blvd., San Francisco, Calif. 94118

[21] Appl. No.: 689,744

[22] Filed: May 25, 1976

[51] Int. Cl.[2] ..... A63C 1/30; B62B 13/06

[52] U.S. Cl. ..... 280/11.12; 280/7.13; 280/11.18; 280/11.2; 280/87.04 A

[58] Field of Search ..... 280/11.12, 11.19, 11.18, 280/11.2, 7.13, 13, 18, 28.5, 87.04 R, 87.04 A; 301/5.3, 5.7

[56] References Cited

U.S. PATENT DOCUMENTS

| | | | |
|---|---|---|---|
| 1,489,197 | 4/1924 | Daverkosen et al. | 280/11.19 |
| 2,242,870 | 5/1941 | Prosey | 280/11.18 |
| 2,988,369 | 6/1961 | Rebicek | 280/11.18 |
| 3,628,804 | 12/1971 | Carreiro | 280/18 |
| 3,738,674 | 6/1973 | Pauls | 280/11.37 B |
| 3,879,047 | 4/1975 | MacDonald | 280/11.12 |
| 3,982,766 | 9/1976 | Budge | 280/11.37 S |

FOREIGN PATENT DOCUMENTS

| | | | |
|---|---|---|---|
| 1,029,590 | 5/1966 | United Kingdom | 280/87.04 A |

*Primary Examiner*—Philip Goodman
*Assistant Examiner*—David M. Mitchell

[57] ABSTRACT

A recreational device comprises an elongated board-like member for supporting the user and runner mounting means affixed in tandem to the underside of the member with two pairs of spaced parallel ice runners attached to the runner mounting means. Each such runner has a plurality of ice contacting portions selectively positionable for contact with the ice.

4 Claims, 4 Drawing Figures

RECREATIONAL DEVICE

BACKGROUND OF THE INVENTION

This invention relates to recreational devices and more particularly to devices for carrying a user in gliding movement across an ice surface.

In the field of winter-time recreational equipment ice skates have long been highly popular for enabling a user to glide across an ice surface. However, ice skates can be inconvenient because of their awkward nature off the ice, thus requiring that a user wear a conventional form of shoes to the ice surface and then put on the ice skates. Similarly, when leaving the ice surface, it is inconvenient to continue wearing the ice skate, thus necessitating that the skates, and the boots to which they are attached, be removed and conventional shoes, once again, be donned. A far more convenient device for use on the ice would be a structure upon which a user could stand in conventional shoes. While some people have attempted to use snow sleds on ice, the extremely limited lateral control of such a snow sled on ice and its very limited turning ability have rendered it unsuitable and even dangerous for such ice usage. On dry surfaces a popular recreational device has become the roller skate board, upon which a user stands for rolling movement along a sidewalk or other hard and generally flat surface. Such roller skate boards have enjoyed great popularity but are completely unsuited for use on ice surfaces due to their lack of control on any such frozen surface.

SUMMARY OF THE INVENTION

It is an object of the present invention to provide a recreational device suitable for use on ice surfaces which does not require the user to wear any special form of boots. It is another object of the invention to provide such a recreational device which incorporates both lateral control on ice and the ability of a user to turn and maneuver easily on ice. It is yet another object of this invention to provide such a recreational device in which the ice runners contacting the ice are selectively positionable to bring different portions thereof into contact with the ice to provide for additional, sharp ice contacting areas on the runners when one such area becomes dull.

Briefly, this invention contemplates a recreational device for use on ice which comprises an elongated board-like member for supporting a user with runner mounting means affixed to the underside of the member, such mounting means comprising a first mount positioned proximal one end of the member and a second mount in tandem with the first mount and positioned proximal with the other end of the member. Each such runner mount includes means for attaching a pair of ice runners thereto in spaced parallel relationship and for providing for pivoting movement of such runners relative to the longitudinal axis of the board-like member in response to a shift of weight of the user on the member. Two pairs of ice runners are selectively rotatably attached to the runner mounting means, one pair to each such mount, each such runner having a plurality of ice contacting portions selectively positionable for ice contact by any selected one of such portion. By means of this structure, one such ice contacting portion of each runner may be selected for ice contact until it has been dulled by usage, and then the runners may be repositioned to bring another such portion into ice contacting position to effect a renewal of the ice contacting areas of the runner.

DESCRIPTION OF A PREFERRED EMBODIMENT

Figure 1:
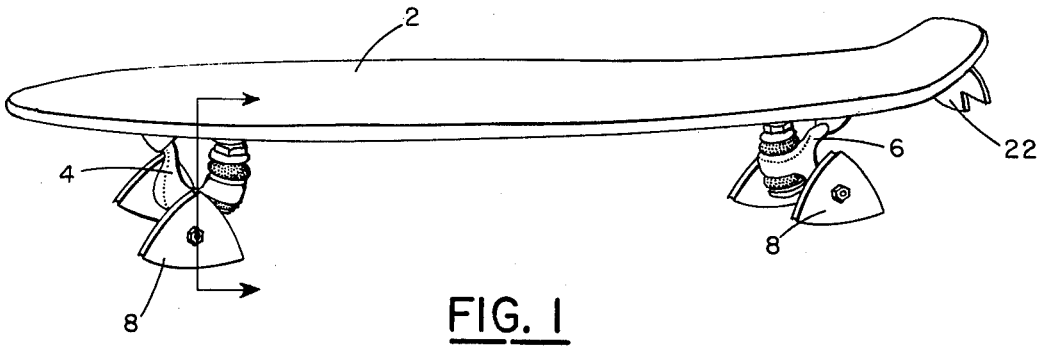
FIG. 1 is a perspective view of the recreational device of this invention.

The recreational device of this invention, as illustrated in FIG. 1 of the drawings, comprises essentially an elongated board-like member 2 for supporting a user, runner mounting means 4 and 6 affixed to the underside of the member 2 and a plurality of ice runners 8 attached to the runner mounting means 4 and 6.

The elongated board-like member 2 may be formed either from wood, synthetic resin or a multi-layer composite of resin impregnated glass cloth or other suitable materials. The runner mounting structures 4 and 6, affixed to the underside of the member 2 by screws, resin bonding or other suitable methods, are conventional as found on roller skate boards. These runner mounting structures normally maintain the runners 8 aligned with the longitudinal axis of the member 2 but also provide for some pivoting movement of the mounting structures, and thus the runners 8, relative to this longitudinal axis of the member 2 in response to a shift of weight by a user standing on the member 2.

The ice runners 8 incorporated in this invention are of unusual and unique form, each runner having a plurality of ice contacting portions selectively and being selectively positionable for ice contact by any one of these portions. In a preferred embodiment, the runner structure is in the form of a convexly arcuate triangle with the downwardly facing base of such triangle forming the ice contacting portion of the runner. These runners 8, fabricated of steel or other suitable material, are affixed to the mounting structures 4 and 6 by means providing for selective repositioning of the runners such as by rotation. In this embodiment the attachement is in the form of a shaft 10 having a shoulder 12 and a threaded portion 14 extending through the runner 8. A nut 16 is threaded onto the outer end of threaded portion 14 for clamping the runner 8 against the shoulder 12. Thus, by releasing the nut 16, the triangular runner 8 may be selectively positioned with any one of the three sides thereof facing downwardly as the ice contacting portion of the runner.

Figure 2:
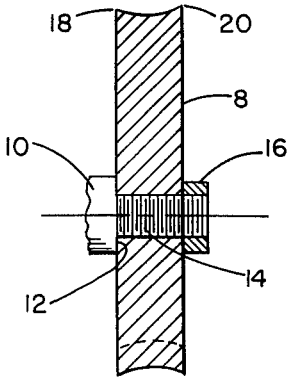
FIG. 2 is a section of the ice runner of the device of FIG. 1, taken along line 2—2.

As may be seen in FIG. 2, the radially outermost portion of the runner 8 is convexly ground to provide a pair of ice gripping edges 18 and 20, thus to provide lateral control for a user. For maximum lateral conrol, it is desirable that these edges 18 and 20 maintained in a sharpened condition. However, prolonged usage of this recreational devive tends to wear down and dull these edges 18 and 20. By the structure of this invention, upon such dulling, the nut 16 may be loosened and the runner 8 repositioned by rotation (in this case, 120° ) to brng another, sharp-edged side of the runner into the ice contacting position. Upon this repositioning the nut 16 is then retightened to hold this new portion of the runner in position to contact the ice.

Figure 3:
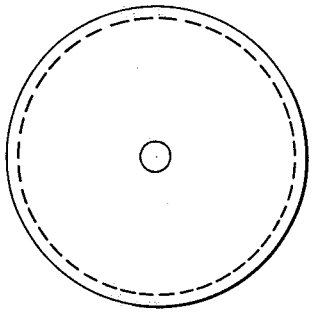
FIG. 3 is an alternative embodiment of an ice runner for the device of FIG. 1.
Figure 4:
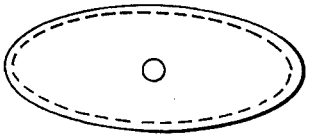
FIG. 4 illustrates a second alternative embodiment of an ice runner for the device of FIG. 1.

While the convexly arcuate triangular configuration for runners has been found to be especially suitable, obviously the same benefits could be obtained from a runner having a profile in the form of any convexually arcuate polygon. Similarly, a circular runner, such as shown in FIG. 3, or an oval-shaped runner as shown in FIG. 4, is also highly suitable, both providing for a repositioning upon the dulling of each ice contacting area thereof. It may further be noted that a non-polygonal runner arcuate runner having only a single ice contacting surface may be used with this invention, although it would lack the above-described benefits of repositioning to bring selectively different portions into contact with the ice to effect a renewal of dulled ice-contacting areas of the runners.

An additional desirable feature incorporated in the recreational device of this invention is the toothed braking structure 22 affixed to the underside of the member 2 adjacent the rear end thereof. This braking structure 22 conveniently may be in the form of a downwardly projecting toothed steel plate bonded or screwed to the underside of the member 2. The braking device 22 is positioned so that in normal gliding usage of the ice skate board the teeth are out of contact with the ice, thus providing no interference to the gliding action. However, when braking action is desired the user may shift his weight backward on the member 2, thus tipping the rear end of the board 2 downwardly and bringing the toothed braking structure 22 into contact with the ice and thus providing for selective braking action.

While the foregoing represents a preferred embodiment of the device of this invention, it is to be considered only as illustrative of the principles of the invention and not limitative thereof. Accordingly, since numerous modifications and changes to this structure, all within the scope of this invention, will readily occur to those skilled in the art, the scope of this invention is to be limited solely by the claims appended hereto.

What is claimed is:

1. A recreational device for use on ice, comprising an elongated board-like member for supporting a user;

runner mounting means affixed to the underside of said member, said mounting means comprising a first mount positioned proximal one end of said member and a second mount in tandem with said first mount and positioned proximal the other end of said member, each said mount including means for attaching a pair of ice runners thereto in spaced, parallel relationship and for providing for pivoting movement of such runners relative to the longitudinal axis of said member in response to a shift of weight of said user on said member; and two pairs of ice runners attached to said runner mounting means by means providing for selective repositioning of said runners, one pair to each said mount, each said runner having a plurality of ice-contacting portions selectively positionable for ice contact by any selected one of said portions and each said runner being generally polygonal in profile with each side of said polygon being convexly arcuate, whereby one such ice contacting portion of each runner may be selected for ice contact until it has been dulled by usage and then the runners may be repositioned to bring another such portion into ice-contacting position to effect a renewal of the ice-contacting areas of the runners.

2. A recreational device according to claim 1 wherein each said runner is generally triangular in profile.

3. A recreational device according to claim 1 further comprising toothed braking means affixed to the underside of said board-like member for selective engagement with an ice surface upon which said device is used.

4. A recreational device for use on ice, comprising an elongated board-like member for supporting a user;

runner mounting means affixed to the underside of said member, said mounting means comprising a first mount positioned proximal one end of said member and a second mount in tandem with said first mount and positioned proximal the other end of said member, each said mount including means for attaching a pair of ice runners thereto in spaced, parallel relationship and for providing for pivoting movement of such runners relative to the longitudinal axis of said member in response to a shift of weight of said user on said member; and two pairs of ice runners attached to said runner mounting means by means providing for selective repositioning of said runners, one pair to each said mount, each said runner having a plurality of ice-contacting portions selectively positionable for ice contact by any selected one of said portions and each said runner being generally oval-shaped in profile, whereby one such ice contacting portion of each runner may be selected for ice contact until it has been dulled by usage and then the runners may be repositioned to bring another such portion into ice-contacting position to effect a renewal of the ice-contacting areas of the runners.

* * * * *